US007651215B2

(12) United States Patent
Hoshino

(10) Patent No.: US 7,651,215 B2
(45) Date of Patent: Jan. 26, 2010

(54) INK JET RECORDING APPARATUS

(75) Inventor: Yoshihide Hoshino, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 4 days.

(21) Appl. No.: 12/265,675

(22) Filed: Nov. 5, 2008

(65) Prior Publication Data

US 2009/0073198 A1 Mar. 19, 2009

Related U.S. Application Data

(62) Division of application No. 10/970,073, filed on Oct. 21, 2004, now Pat. No. 7,458,673.

(30) Foreign Application Priority Data

Oct. 29, 2003 (JP) ..... 2003-369146

(51) Int. Cl.
*B41J 2/01* (2006.01)
*B41J 2/205* (2006.01)

(52) U.S. Cl. ..... 347/102; 347/15

(58) Field of Classification Search ..... 347/102, 347/101, 15, 21, 37; 101/488; 219/216; 346/25

See application file for complete search history.

(56) References Cited

U.S. PATENT DOCUMENTS 5,371,531 A 12/1994 Rezanka et al.
6,273,550 B1 * 8/2001 Brown ..... 347/43
6,550,882 B2 4/2003 Koitabashi et al.
6,562,413 B1 5/2003 Morgavi
6,669,331 B2 * 12/2003 Teshigawara et al. ..... 347/43
6,786,589 B2 9/2004 Suzuki et al.
6,834,948 B2 12/2004 Asano et al.
7,108,366 B2 9/2006 Ishikawa
7,244,021 B2 7/2007 Arai
2001/0020964 A1 9/2001 Irihara et al.
2003/0007814 A1 * 1/2003 Richards ..... 399/341
2003/0035037 A1 * 2/2003 Mills et al. ..... 347/102
2003/0142168 A1 7/2003 Suzuki et al.

(Continued)

FOREIGN PATENT DOCUMENTS

EP 0 897 800 A2 2/1999

(Continued)

*Primary Examiner*—Stephen D Meier
*Assistant Examiner*—Leonard S Liang
(74) *Attorney, Agent, or Firm*—Frishauf, Holtz, Goodman & Chick, P.C.

(57) ABSTRACT

To reduce ink bleeding and growing of dot diameters for high image quality, an ink jet recording apparatus for recording a color image includes a first head group including chromatic color ink recording heads, a second head group including at least one of a transparent ink recording head and an achromatic color ink recording head, and light emitting devices for curing a photocurable ink having landed on a recording medium. The first and the second head groups are disposed along a scanning direction. The chromatic color ink recording heads of the first head group do not have the light emitting device therebetween along the scanning direction. And the light emitting device is arranged along the scanning direction between the first and second head groups and further arranged at least on a trailing side, in the scanning direction, of a trailing one of the first and second head groups.

1 Claim, 3 Drawing Sheets

U.S. PATENT DOCUMENTS

| | | | | |
|---|---|---|---|---|
| 2003/0164870 | A1 | 9/2003 | Yamamoto | |
| 2003/0234848 | A1 | 12/2003 | Ishikawa | |
| 2004/0104987 | A1* | 6/2004 | Smith et al. | 347/101 |
| 2004/0114016 | A1 | 6/2004 | Yokoyama | |
| 2004/0114017 | A1 | 6/2004 | Yokoyama | |
| 2004/0174403 | A1* | 9/2004 | Yoshida et al. | 347/15 |
| 2004/0189771 | A1 | 9/2004 | Hasebe et al. | |

FOREIGN PATENT DOCUMENTS

| | | | |
|---|---|---|---|
| EP | 1 208 989 | A2 | 5/2002 |
| EP | 1 302 324 | A1 | 4/2003 |
| JP | 2001-310454 | A | 11/2001 |
| JP | 2003-191601 | A | 7/2003 |

* cited by examiner

INK JET RECORDING APPARATUS

CROSS-REFERENCE TO RELATED APPLICATION

The present application is a Divisional Application of U.S. application Ser. No. 10/970,073 filed Oct. 21, 2004, now U.S. Pat. No. 7,458,673 which is incorporated herein by reference.

FIELD OF THE INVENTION

The present invention relates to an ink jet recording apparatus, and particularly relates to an ink jet recording apparatus that uses a photocurable ink.

BACKGROUND OF THE INVENTION

Conventionally, there have been offered ink jet recording apparatuses that jet ink onto a recording medium such as a paper sheet or a plastic thin plate to record a certain image, and those apparatuses have been put into practical use. Particularly in recent years, to enable image recording even on a non-absorbent recording medium, ink jet recording apparatuses have been developed which form an image by using a photocurable ink and emitting light such as UV-ray to the ink having landed on the recording medium. As an example of such ink jet recording apparatuses, there have been developed apparatuses which use a radical polymerization ink and emit a large amount of UV-rays at a time (for example, see Patent Document 1). There have also been offered ink jet recording apparatuses which use transparent ink and record an image for evenness in luster (for example, see Patent Document 2).

[Patent Document 1] TOKKAI No. 2001-310454

[Patent Document 2] TOKKAI No. 2003-191601

The above ink jet recording apparatuses mix a plurality of different color inks on a recording medium, and then cure the inks by emitting UV-rays to record an image. However, when a dot of a white ink or a black ink, for example, is formed on or in the vicinity of a dot of mixed color inks, for example, a cyan, magenta, and yellow ink, the white or black ink is mixed with the color inks and bleeds, resulting in image degradation.

On the other hand, even with an ink jet recording apparatus using a transparent ink, the transparent ink is mixed with another ink before all inks are cured on a recording medium, resulting in image degradation.

SUMMARY OF THE INVENTION

An object of the invention is to reduce ink bleeding and growing of a dot diameter for high image quality, which can be attained by the following structures, for example.

(1-1) An ink jet recording apparatus for recording a color image has a first head group including a plurality of chromatic color ink recording heads for jetting a plurality of photocurable chromatic color inks; a second head group including at least one of a transparent ink recording head for jetting a photocurable transparent ink and an achromatic color ink recording head for jetting a photocurable achromatic color ink; and light emitting devices for emitting light to the respective photocurable inks having landed on a recording medium to cure the inks, wherein, the first head group and the second head group are disposed along a scanning direction; the plurality of the chromatic color ink recording heads of the first head group does not have the light emitting device therebetween along the scanning direction so that the plurality of the chromatic color inks are superimposedly mixed without being cured; the light emitting device is arranged along the scanning direction between the first head group and the second head group so that at least said one of the transparent ink and the achromatic color ink, and the plurality of chromatic color inks are relatively cured and superimposed; and the light emitting device is further arranged along the scanning direction at least on a trailing side, in the scanning direction, of a trailing one of the first head group and the second head group.

According to item (1-1), ink in the first head group and ink in the second head group are cured each individually. Therefore, the ink in the first head group and the ink in the second head group are prevented from mixing with each other, which reduces ink bleeding and reduces increase in a dot diameter to improve the image quality.

The ink jet recording apparatus Includes serial printers and line printers.

(1-2) In the ink jet recording apparatus of item (1-1) for recording a color image, the second head group includes one of a black ink recording head and a white ink recording head and includes a transparent ink recording head, and the light emitting device is further arranged along the scanning direction between said one of the black ink recording head and the white ink recording head, and the transparent recording head.

PREFERRED EMBODIMENTS OF THE INVENTION

Figure 1:
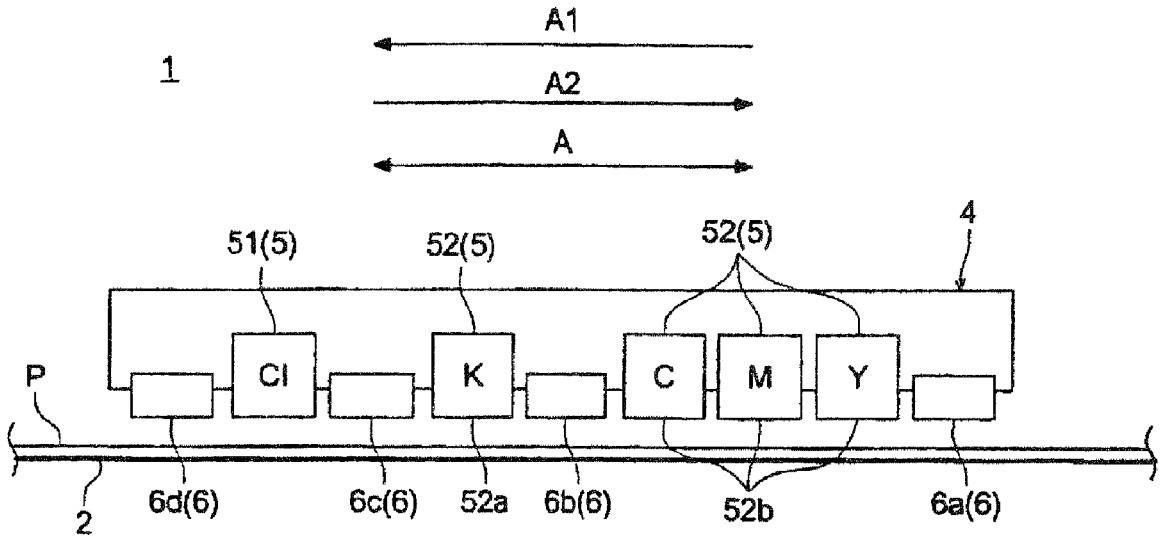
FIG. 1 is a diagram showing a principal structure of an ink jet recording apparatus in a first embodiment.

Preferred structures of an ink jet recording apparatus in accordance with the invention will be described below.

(2-1) An ink jet recording apparatus comprises a coloring ink recording head for jetting a photocurable coloring ink onto a recording medium, a transparent ink recording head for jetting a photocurable transparent ink onto the recording medium, respective light emitting devices for emitting light to the coloring ink and the transparent ink having landed on the recording medium to cure the inks, and a controlling device for controlling the coloring ink recording head and the transparent ink recording head. The controlling device, herein, at least, either performs controlling of the coloring ink recording head and the transparent ink recording head in such a manner that the coloring ink recording head jets the coloring ink onto the recording medium, and after the coloring ink on the recording medium has been cured by the light emitting device, the transparent ink recording head jets the transparent ink onto the recording medium and the transparent ink on the recording medium is cured by the light emitting device, or performs controlling of the coloring ink recording head and the transparent ink recording head in such a manner that the transparent ink recording head jets the transparent ink onto the recording medium, and after the transparent ink on the recording medium has been cured by the light emitting device, the coloring ink recording head jets the coloring ink onto the recording medium and the coloring ink on the recording medium is cured by the light emitting device.

(2-2) The ink jet recording apparatus of item (2-1) includes a scanning device for scanning the coloring ink recording head and the transparent ink recording head, and a conveying device for conveying the recording medium in a direction orthogonal to the scanning direction by the scanning device. On the scanning device, a plurality of the above light emitting devices is disposed at least on the both sides of either the coloring ink recording head or the transparent ink recording head.

(2-3) In the ink jet recording apparatus of item (2-2), on the scanning device, a plurality of the above light emitting devices is disposed at least on the both sides of both the coloring ink recording head and the transparent ink recording head respectively.

(2-4) In the ink jet recording apparatus of item (2-2) or (2-3), the controlling device controls the light emitting devices in such a manner that each of the light emitting devices burns only when either the coloring ink or the transparent ink lands on the recording medium on the downstream side, in the scanning direction, of the respective light emitting device.

(2-5) The ink jet recording apparatus of item (2-1) includes a conveying device for conveying the recording medium. The coloring ink recording head and the transparent ink recording head are recording heads of a line-head type, wherein the recording heads are disposed along a conveying direction of the conveying device. A plurality of the light emitting devices is disposed on the downstream side, in the conveying direction, of the coloring ink recording head and on the downstream side, in the conveying direction, of the transparent ink recording head.

(2-6) With the ink jet recording apparatus of any one of items (2-1) to (2-5), the light emitting amount by the light emitting device in curing the transparent ink is less than the light emitting amount by the light emitting device in curing the coloring ink.

(2-7) An ink jet recording apparatus comprises a white ink recording head for jetting a photocurable white ink onto a recording medium, a basic color ink recording head for jetting a photocurable basic color ink of a color other than the color of the white ink onto the recording medium, respective light emitting devices for emitting light to the white ink and the basic color ink having landed on the recording medium to cure the inks, and a controlling device for controlling the white ink recording head and the basic color ink recording head. The controlling device, herein, at least either performs controlling of the white ink recording head and the basic color ink recording head in such a manner that the white ink recording head jets the white ink onto the recording medium, and after the white ink on the recording medium has been cured by the light emitting device, the basic color ink recording head jets the basic color ink onto the recording medium and the basic color ink on the recording medium is cured by the light emitting device, or performs controlling of the white ink recording head and the basic color ink recording head in such a manner that the basic color ink recording head jets the basic color ink onto the recording medium, and after the basic color ink on the recording medium has been cured by the light emitting device, the white ink recording head jets the white ink onto the recording medium and the white ink on the recording medium is cured by the light emitting device.

(2-8) The ink jet recording apparatus of item (2-7) includes a scanning device for scanning the white ink recording head and the basic color ink recording head, and a conveying device for conveying the recording medium in a direction orthogonal to the scanning direction of the scanning device. On the scanning device, a plurality of the above light emitting devices is disposed at least on the both sides of either the white ink recording head or the basic color ink recording head.

(2-9) In the ink jet recording apparatus of item (2-8), on the scanning device, a plurality of the above light emitting devices is at least disposed on the both sides of both the white ink recording head and the basic color ink recording head.

(2-10) In the ink jet recording apparatus of item of item (2-8) or (2-9), the controlling device controls the light emitting devices in such a manner that each of the light emitting devices burns only when either the white ink or the basic color ink lands on the recording medium on the downstream side, in the scanning direction, of the respective light emitting device.

(2-11) The ink jet recording apparatus of item (2-7) includes a conveying device for conveying the recording medium. The white ink recording head and the basic color ink recording head are recording heads of a line-head type, wherein the recording heads are disposed along a conveying direction of the conveying device. A plurality of the light emitting devices is disposed on the downstream side, in the conveying direction, of the white ink recording head and on the downstream side, in the conveying direction, of the basic color ink recording head.

(2-12) For the ink jet recording apparatus of any one of item (2-1) to (2-11), the coloring ink or the basic color ink includes inks in respective four colors of cyan, magenta, yellow, and black.

(2-13) An ink let recording apparatus comprises a black ink recording head for jetting a photocurable black ink onto a recording medium, a color ink recording head for jetting a photocurable color ink onto the recording medium, respective light emitting devices for emitting light to the black ink and the color ink having landed on the recording medium to cure the inks, and a controlling device for controlling the black ink recording head and the color ink recording head. The controlling device, herein, at least either performs controlling of the black ink recording head and the color ink recording head in such a manner that the black ink recording head jets the black ink onto the recording medium, and after the black ink on the recording medium has been cured by the light emitting device, the color ink recording head jets the color ink onto the recording medium and the color ink on the recording medium is cured by the light emitting device, or performs controlling of the black ink recording head and the color ink recording head in such a manner that the color ink recording head jets the color ink onto the recording medium, and after the color ink on the recording medium has been cured by the light emitting device, the black ink recording head jets the black ink onto the recording medium and the black ink on the recording medium is cured by the light emitting device.

(2-14) The ink jet recording apparatus of item (2-13) includes a scanning device for scanning the black ink recording head and the color ink recording head, and a conveying device for conveying the recording medium in a direction orthogonal to the scanning direction by the scanning device. On the scanning device, a plurality of the above light emitting devices is disposed at least on the both sides of either the black ink recording head or the color ink recording head.

(2-15) In the ink jet recording apparatus of item (2-14), on the scanning device, a plurality of the above light emitting devices is disposed at least on the both sides of both the black ink recording head and the color ink recording head.

(2-16) In the ink jet recording apparatus of item of item (2-14) or (2-15), the controlling device controls the light emitting devices in such a manner that each of the light emitting devices burns only when either the black ink or the color ink lands on the recording medium on the downstream side, in the scanning direction, of the respective light emitting device.

(2-17) The ink jet recording apparatus of item (2-13) includes a conveying device for conveying the recording medium. The black ink recording head and the color ink recording head are recording heads of a line-head type, wherein the recording heads are disposed along a conveying direction of the conveying device. A plurality of the light emitting devices is disposed on the downstream side, in the conveying direction, of the black recording head and on the downstream side, in the conveying direction, of the color ink recording head.

(2-18) For the ink jet recording apparatus of any one of items (2-1) to (2-17), the inks are UV-curable inks and the light emitting devices emit a UV-ray at least as a part of emitting light.

According to item (2-1), the coloring ink and the transparent ink are cured each individually. Therefore, the colored ink and the Transparent ink are prevented from mixing with each other, which reduces ink bleeding and reduces increase in a dot diameter to improve the image quality.

According to item (2-2), also with a serial type ink jet recording apparatus, the same effects as those by item (2-1) can be achieved.

According to item (2-3), a plurality of the light emitting devices is arranged on the both sides of the color ink recording head and the transparent ink recording head respectively. Therefore, image recording with the coloring ink and image recording with the transparent ink are possible at one scanning operation, improving the recording speed.

According to item (2-4), each of the light emitting devices burns only when either the coloring ink or the transparent ink lands on the recording medium on the downstream side, in the scanning direction, of the respective light emitting device. Therefore, even securely curing the coloring ink and the transparent ink on the recording medium, unnecessary emitting by the light emitting devices can be prevented and the consumption electric power can be reduced.

According to item (2-5), also with a line type ink jet recording apparatus, the same effects as those in item (2-1) can be achieved.

In a case of emitting a light to a coloring ink, the light is inhibited by a colorant contained in the coloring ink, while in a case of emitting a light to a transparent ink, the light is not inhibited because the transparent ink does not contain a colorant. That is, for the same amount of ink, the transparent ink is cured with a smaller emitting amount than a case of curing a coloring ink. According to item (6), even with a smaller emitting amount of a light emitting device in curing the transparent ink than the emitting amount of a light emitting device in curing the coloring ink, both the transparent ink and the coloring ink can be cured. Therefore, it is possible to emit light with an emitting amount depending on the type of an ink, and thus prevent the emitting amount from exceeding a required value, thus reducing the consumption electric power.

According to item (2-7), the white ink and the basic color ink are cured each individually. Therefore, the white ink and the basic color ink are prevented from mixing with each other, which reduces ink bleeding and reduces increase in a dot diameter to improve the image quality.

According to item (2-8), also with a serial type ink jet recording medium, the same effects as those by item (2-7) can be achieved.

According to item (2-9), as a plurality of the light emitting devices is arranged on the both sides of the white ink recording head and the basic color ink recording head respectively, image recording with the white ink and image recording with the basic color ink are possible at one scanning operation, improving the recording speed.

According to item (2-10), each of the light emitting devices burns only when either the white ink or the basic color ink lands on the recording medium on the downstream side, in the scanning direction, of the respective light emitting device. Therefore, even securely curing the white ink and the basic color ink on the recording medium, unnecessary emitting by the light emitting devices can be prevented and the consumption electric power can be reduced.

According to item (2-11), also with a line type ink jet recording apparatus, the same effects as those in item (2-7) can be achieved.

According to item (2-12), also with the ink jet recording apparatus using four colors of cyan, magenta, yellow, and black, the same effects as those in any one of items (2-1) to (2-11) can be achieved.

According to item (2-13), the black ink and the color ink are cured each individually. Therefore, the black ink and the color ink are prevented from mixing with each other, which reduces ink bleeding and reduces increase in a dot diameter to improve the image quality.

According to item (2-14), also with a serial type ink jet recording medium, the same effects as those by item (2-13) can be achieved.

According to item (2-15), as a plurality of the light emitting devices is arranged on the both sides of the black ink recording head and the color ink recording head respectively. Therefore, image recording with the black ink and image recording with the color ink are possible at one scanning operation, improving the recording speed.

According to item (2-16), each of the light emitting devices burns only when either the black ink or the color ink lands on the recording medium on the downstream side, in the scanning direction, of the respective light emitting device. Therefore, even securely curing the black ink and the color ink on the recording medium, unnecessary emitting by the light emitting devices can be prevented and the consumption electric power can be reduced.

According to item (2-17), also with a line type ink jet recording apparatus, the same effects as those in item (2-13) can be achieved.

According to item (2-18), also with a UV-curable ink jet recording apparatus, the same effects as those in any one of item (2-1) to (2-17) can be achieved.

First Embodiment

A first embodiment of the invention will be described referring to the drawings. An embodiment of the invention is described below without limiting the invention.

First, a primary structure of an ink jet recording apparatus of the present embodiment will be described referring to FIG. 1 that is a diagram showing a principal structure of the ink jet apparatus.

The ink jet recording apparatus 1 is a serial ink jet recording apparatus that jets UV-ray curable ink while scanning a recording head on a recording medium, and thus records an image on the recording medium. The ink jet recording apparatus 1 is provided with a platen 2 for supporting a recording medium P at the lower side thereof and a conveying device 3 (see FIG. 2) for conveying the recording medium P supported by the platen 2. Above the platen 2, a carriage 4 is arranged as a scanning device that scans in a direction orthogonal to the conveying direction of the recording medium P.

On the carriage 4, there are disposed, along a scanning direction A, a plurality of recording heads 5 for jetting ink to the recording medium P supported by the platen 2. Specifically, the plurality of recording heads 5 is a transparent ink recording head 51 for jetting a transparent ink (C1) containing no colorant and coloring ink recording heads 52 for jetting respective color inks containing a colorant. The coloring inks include a black ink (K) containing a black colorant and color inks containing a colorant other than a black colorant. This means that the coloring ink recording heads 52 include a black ink recording head 52*a* for jetting a black ink and color ink recording heads 52*b* for jetting a color ink. In the present invention, three color inks are used that are cyan (C), magenta (M), and yellow (Y) as the color inks, and accordingly, three color ink recording heads 52*b* are mounted on the carriage 4, corresponding to the respective color inks.

Further, The carriage 4 is provided with a plurality of light emitting devices 6 for emitting lights including UV-rays toward the recording medium P, on the respective both sides, in the scanning direction A, of the transparent ink recording head 51, the black ink recording head 52*a*, and the color ink recording heads 52*b* respectively.

Figure 2:
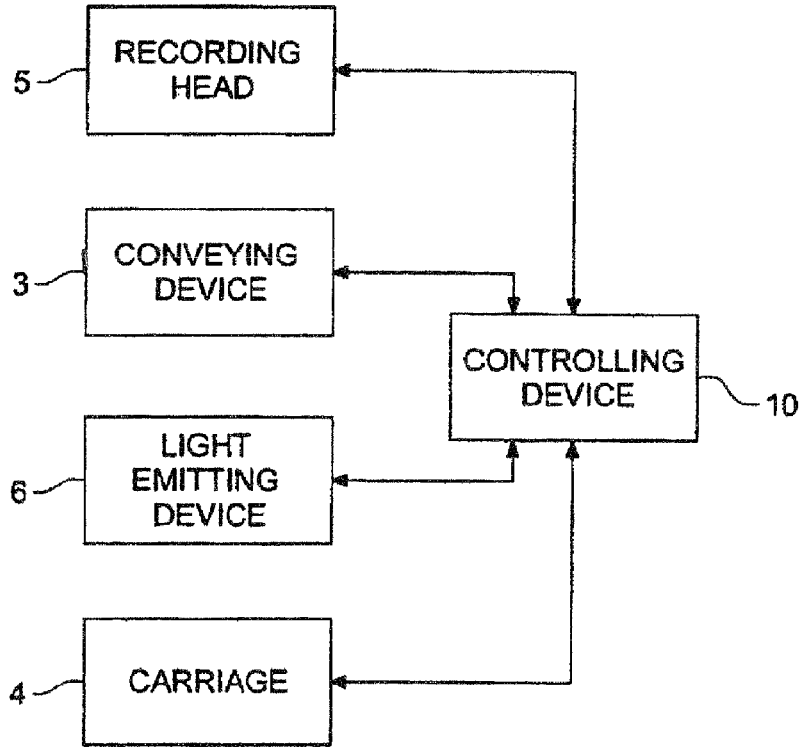
FIG. 2 is a block diagram showing a main control section of the ink jet recording apparatus in FIG. 1.

FIG. 2 is a block diagram showing a primary control section of the ink jet recording apparatus 1. As shown in FIG. 2, the ink jet recording apparatus 1 includes a controlling device 10 for controlling each driving section. The controlling device 10 is configured by an interface, a recording circuit, a CPU, and so on, and controls various devices connected to the interface, according to a control program and control data written in the recording circuit.

The interface is electrically connected with respective driving sources of the conveying device 3, the carriage 4, the recording heads 5, and the light sources of the light emitting devices 6. In addition, this interface is further connected with respective driving sections and the like of the ink jet recording apparatus 1.

The CPU extends each program designated from among various programs stored in the recording circuit into a working area in the recording circuit. Thus, the CPU executes various processes according to the respective programs in response to input signals from respective sections.

Next, the operation of the ink jet recording apparatus 1 of the present embodiment will be described.

The controlling device 10 controls the conveying device 3 in such a manner that the recording medium P is intermittently conveyed at a timing of recording an image. When the recording medium P is in a stop state during the intermittent conveying, the controlling device 10 controls the carriage 4 to scan the recording heads 5 on the recording medium P. During scanning the carriage 4, the controlling device 10 controls the recording heads 5 so that the respective recording heads 5 jet ink, controls the light emitting devices 6 so that the light emitting devices 6 emit light toward the recording medium P, and thus an image is recorded on the recording medium P.

In a case where the carriage 4 scans in an arrow A1 direction shown in FIG. 1, a light emitting device 6*a* on the first upstream position cures the color inks having landed on the recording medium P in the present scanning; a light emitting device 6*b* on the second upstream position cures the black ink having landed on the recording medium in the present scanning; and a light emitting device 6*c* on the third upstream position cures the transparent ink having landed on the recording medium P in the present scanning. On the other hand, in a case where the carriage 4 scans in an arrow A2 direction shown in FIG. 1, that is in the direction opposite to the arrow A1 direction, the light emitting device 6*d* on the first upstream position cures the transparent ink having landed on the recording medium P in the present scanning; the light emitting device 6*c* on the second upstream position cures the black ink having landed on the recording medium P in the present scanning; and the light emitting device 6*b* on the third upstream position cures the color inks having landed on the recording medium P in the present scanning.

As described above, the respective light emitting devices 6 cure respective different inks depending on the scanning directions A1 and A2. Therefore, in each direction of A1 and A2, the controlling device 10 controls the respective light emitting devices 6 in such a manner that the emission amount of the light emitting device 6 that cures the transparent ink is less than the emission amount of the light emitting devices 6 that cure the coloring inks including the black ink and the color inks.

Curing mentioned here may be complete curing of entire ink droplets having landed on the recording medium P or initial curing of a surface portion of ink droplets to a degree that the ink droplets do not mix with other ink droplets.

Thus, in the case where the carriage 4 scans in the scanning direction A1, first, the transparent ink recording head 51 jets the transparent ink on the recording medium P, and the light emitting device 6*c* cures the transparent ink on the recording medium P. Next, the black ink recording head 52*a* jets the black ink on the recording medium P, and the light emitting device 6*b* cures the black ink on the recording medium P. Finally, the color ink recording heads 52*b* jet the color inks on the recording medium P, and the light emitting device 6*a* cures the color inks on the recording medium P.

On the other hand, in the case where the carriage 4 scans in the scanning direction A2, first, the color ink recording heads 52*b* jet the color inks on the recording medium P, and the light emitting device 6*b* cures the color inks on the recording medium P. Next, the black ink recording head 52*a* jets the black ink on the recording medium P, and the light emitting device 6*c* cures the black ink on the recording medium P. Finally, the transparent ink recording head 51 jets the transparent ink on the recording medium P, and the light emitting device 6*d* cures the transparent ink on the recording medium P.

The above processes are repeated so that an image is recorded on the recording medium P.

The light emitting devices 6*d* and 6*a* at the respective most downstream positions in the scanning directions A1 and A2 do not contribute to ink curing even if they burn because ink is not jetted on the downstream side of the respective positions. Therefore, in the case where the carriage 4 scans in the scanning direction A1, the controlling device 10 controls the light emitting devices 6 such that only the light emitting devices 6*c*, 6*b*, and 6*a* burn because at least one of the transparent ink, the black ink, and the basic color inks lands on the recording medium P on the downstream side, in the scanning direction A1, of the respective light emitting devices 6*c*, 6*b*, and 6*a*, and the light emitting device 6*d* positioned at the most downstream does not burn.

On the other hand, in the case where the carriage 4 scans in the scanning direction A2, the controlling device 10 controls the light emitting devices 6 such that only the light emitting devices 6*b*, 6*c*, and 6*d* burn because at least one of the basic color inks, the black ink, and the transparent ink lands on the recording medium P on the downstream side, in the scanning direction A2, of the respective light emitting devices 6*b*, 6*c*, and 6*d*, and the light emitting device 6*a* located at the most downstream position does not burn.

Incidentally, in a case where the image is recorded not by all of the transparent ink recording head 51, the black ink recording head 52*a*, and the color ink recording heads 52*b* during scanning, in other words, in a case where a recording head 5 is not used during scanning, the light emitting device 6 positioned just upstream to this recording head 5 not used may be controlled not to burn.

As described above, with the ink jet recording apparatus 1 of the present embodiment, the transparent ink, the black ink, and the group of the color inks are cured each Individually. Therefore, the transparent ink, the black ink, and the group of the color inks are prevented from mixing with each other, which reduces ink bleeding and reduces increase in a dot diameter to improve the image quality.

Further, as a plurality of the light emitting devices 6 is arranged on the both sides of the respective transparent ink recording head 51, the black ink recording head 52*a*, and the color ink recording heads 52*b*, image recording with the transparent ink, image recording with the black ink, and image recording with the color inks are possible at one scanning operation, improving the recording speed.

In a case of emitting a light to a coloring ink, the light is inhibited by the colorant contained in the coloring ink, while in a case of emitting a light to a transparent ink, the light is not inhibited because the transparent ink does not contain a colorant. That is, for the same amount of ink, the transparent ink is cured with a smaller emitting amount than a case of curing a coloring ink. Accordingly, likewise the ink jet recording apparatus 1 of the present embodiment, even with a smaller emitting amount of a light emitting device 6 in curing the transparent ink than the emitting amount of a light emitting device 6 in curing coloring inks, both the transparent ink and the coloring inks can be cured. Therefore, it is possible to emit light with an emitting amount depending on the type of an ink, and thus prevent the emitting amount from exceeding a required value, thus reducing the consumption electric power.

Further, according to the scanning directions A1 and A2, burning and non-burning of the respective light emitting devices 6*a*, 6*b*, 6*c*, and 6*d* are switched in such a manner that the respective inks on the recording medium P can be cured. Thus, unnecessary emitting by the light emitting devices 6 can be prevented, which reduces the consumption electric power.

Incidentally, it is apparent that the invention is not limited to the above first embodiment and can be modified as necessary.

For example, although in the present embodiment, the ink jet recording apparatus that performs bidirectional image recording with the carriage 4 has been described as an example, in a case of an ink let recording apparatus that performs image recording only in one direction so that higher resolution image recording can be achieved, the light emitting device 6*d* located at the most downstream position in the scanning direction A1 can be omitted if image recording is performed only in the scanning direction A1, for example.

Further, as long as the transparent ink, the black ink, and the group of the color inks are cured each individually, the location order of the respective recording heads 5 and the respective light emitting devices 6 can be set in any way.

Figure 3:
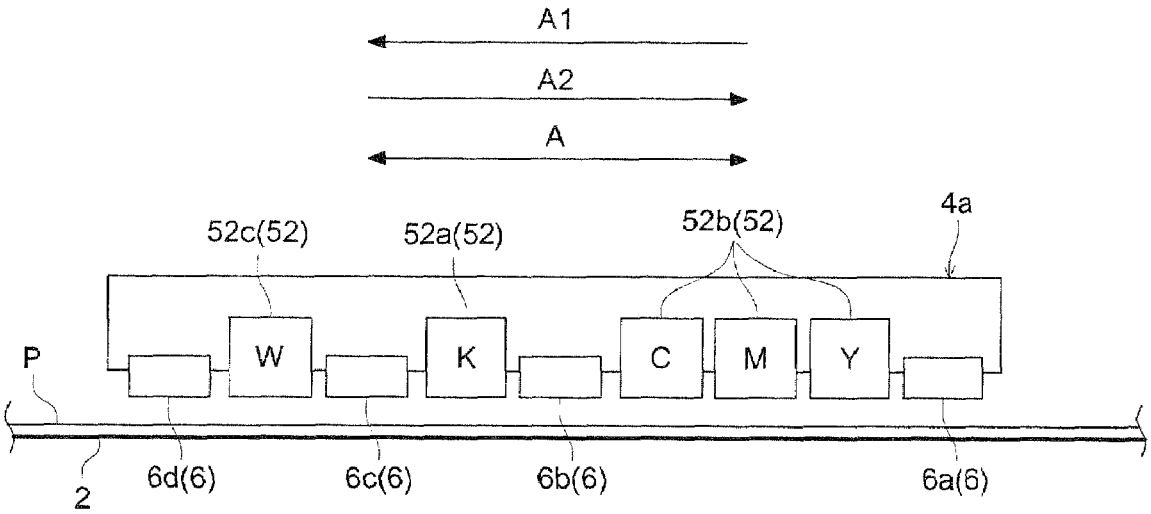
FIG. 3 is a diagram showing a modification, as an example, of a carriage provided on the ink jet recording apparatus in FIG. 1.

In the present embodiment, the carriage 4 having the transparent ink recording head 51 is described as an example, but a carriage having only coloring ink recording heads 52 without having a transparent ink recording head 51 may be employed. For example, as shown in FIG. 3, a carriage 4*a* having a black ink recording head 52*a*, color ink recording heads 52*b*, and a white ink recording head 52*c*, as the coloring ink recording heads 52, can be applied. In the following, this carriage 4*a* will be described referring to FIG. 3, giving the same reference symbols to the same parts as those of the carriage 4 shown in FIG. 1 and omitting the description of them.

On the carriage 4*a*, there are disposed a black ink recording head 52*a*, color ink recording heads 52*b*, and a white ink recoding head 52*c* along a scanning direction A. The white ink recording head 52*c* jets a white ink (W) containing a white colorant toward a recording medium P.

In recording an image with this carriage 4*a*, in a case where the carriage 4*a* scans in the scanning direction A1, first, the white ink recording head 52*c* jets the white ink onto the recording medium P, and the light emitting device 6*c* cures the white ink on the recording medium P. Next, the black ink recording head 52*a* jets the black ink onto the recording medium P, and the light emitting device 6*b* cures the black ink on the recording medium P. Finally, the respective color ink recording heads 52*b* jet the color inks onto the recording medium P, and the light emitting device 6*a* cures the color inks on the recording medium P.

In the case where the carriage 4*a* scans in the scanning direction A1, the controlling device 10 controls the light emitting devices 6 such that only the light emitting devices 6*c*, 6*b*, and 6*a* burn because at least one of the white ink, the black ink, and the basic color inks land on the recording medium P on the downstream side of the respective light emitting devices in the scanning direction A1, and the light emitting device 6*d* positioned at the most downstream does not burn.

On the other hand, in the case where the carriage 4*a* scans in the scanning direction A2, first, the color ink recording heads 52*b* jet the color inks onto the recording medium P, and the light emitting device 6*b* cures the color inks on the recording medium P. Next, the black ink recording head 52*a* jets the black ink onto the recording medium P, and the light emitting device 6*c* cures the black ink on the recording medium P. Finally, the white ink recording head 52*c* jets the white ink onto the recording medium P, and the light emitting device 6*d* cures the white ink on the recording medium P.

In the case where the carriage 4*a* scans in the scanning direction A2, the controlling device 10 controls the light emitting devices 6 such that only the light emitting devices 6*b*, 6*c*, and 6*d* burn because at least one of the basic color inks, the black ink, and the white ink lands on the recording medium P on the downstream side of the respective light emitting devices in the scanning direction A2, and the light emitting device 6*a* located at the most downstream position does not burn.

As described above, the white ink and the group of the basic color inks (the black ink and the color inks) other than the white ink are cured each individually. Therefore, the white ink and the group of the basic color inks are prevented from mixing with each other, which reduces ink bleeding and reduces increase in a dot diameter to improve the image quality. Further, the black ink and the group of the color inks are cured each individually. Therefore, the black ink and the group of the color inks are prevented from mixing with each other, which improves the image quality.

Second Embodiment

Next, an ink jet recording apparatus 1A according to a second embodiment will be described referring to FIG. 4. In the above described first embodiment, an example of a serial type ink jet recording apparatus 1 has been described, while in the second embodiment, a line type ink jet recording apparatus 1A will be described as an example. In the following description, the same reference symbols will be given to elements in common with the ink jet recording apparatus 1 of the first embodiment.

Figure 4:
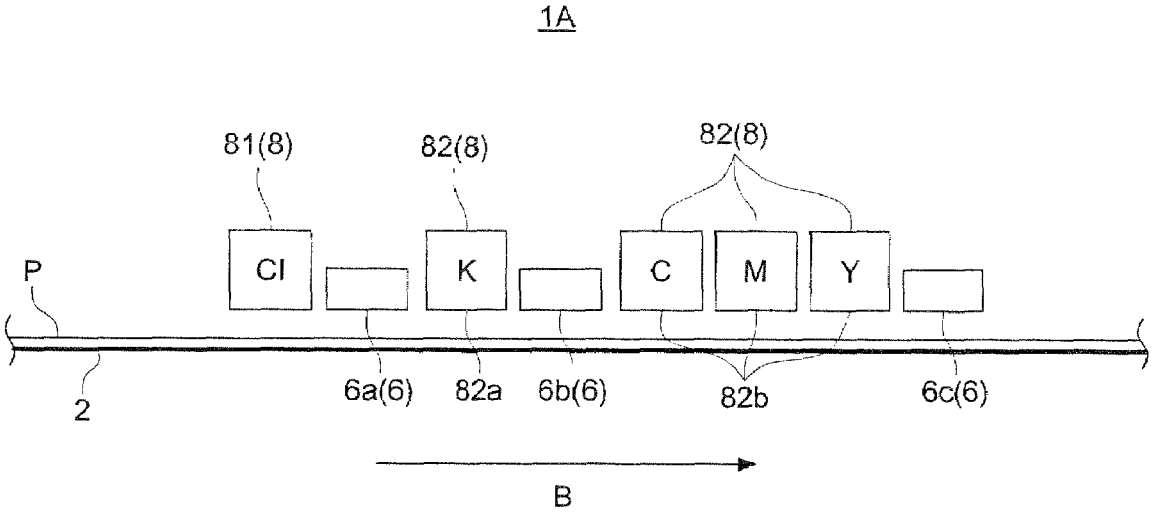
FIG. 4 is a diagram showing a principal structure of an ink jet recording apparatus of a second embodiment.

As shown in FIG. 4, above a platen 2 of the ink jet recording apparatus 1A, a plurality of line-head type recording heads 8 is disposed along a conveyance direction B of a conveying device 3. The plurality of recording heads 8 includes a transparent ink recording head 81 for jetting a transparent ink (C1) containing no colorant and coloring ink recording heads 82 for jetting coloring inks containing a colorant, wherein, since the coloring inks include a black ink (K) containing a black colorant and color inks containing a colorant other than a black colorant, the coloring ink recording heads 82 include a black ink recording head 82*a* for jetting the black ink and color recording heads 82*b* for jetting the color inks. In the present embodiment, color inks in three colors of cyan (C), magenta (M), and yellow (Y) are used as the color inks, and therefore, three color ink recording heads 82*b* are provided corresponding to the color inks.

On each downstream side, in the conveyance direction B, of the transparent recording head 81, the black ink recording head 82*a*, and the group of the color ink recording heads 82*b*, light emitting devices 6 are respectively arranged, and thus the transparent ink, the black ink, and the group of the color inks having landed on a recording medium P are cured each individually.

Next, the operation of the ink jet recording apparatus 1A of the present embodiment will be described.

A controlling device 10 controls the conveying device 3 in such a manner that the recording medium P is continuously conveyed at a timing of image recording. Accompanying the conveyance of the recording medium P, the controlling device 10 controls the recording heads 8 so that the respective recording heads 8 jet ink, controls the light emitting devices 6 so that the light emitting devices 6 emit light toward the recording medium P, and thus an image is recorded on the recording medium P.

When the recording medium P is conveyed in the conveyance direction B, first, the transparent ink recording head 81 jets the transparent ink on the recording medium P, and the light emitting device 6*a* located just downstream side of the transparent ink recording head 81 cures the transparent ink on the recording medium P. Next, the black ink recording head 82*a* jets the black ink on the recording medium P, and the light emitting device 6*b* located just downstream side of the black ink recording head 82*a* cures the black ink on the recording medium P. Finally, the color ink recording heads 82*b* jet the color inks on the recording medium P, and the light emitting device 6*c* located just downstream side of the color ink recording heads 82*b* cures the color inks on the recording medium P.

As described above, also with the line type ink jet recording apparatus 1A, the transparent ink, the black ink, and the group of the color inks are cured each individually. Therefore, the transparent ink, the black ink, and the group of the color inks are prevented from mixing with each other, which reduces ink bleeding and reduces increase in a dot diameter to improve the image quality.

Incidentally, it is apparent that the invention is not limited to the above second embodiment and can be modified as necessary.

For example, although in this second embodiment, a case where the light emitting devices 6 are controlled by the controlling device 10 has been described as an example, even if the light emitting devices 6 are not controlled by the controlling device 10, a line type ink jet recording apparatus can cure the black ink, the color inks, and the transparent ink each individually with a structure, for example, where the light emitting devices 6 start burning upon turning on the power supply.

Figure 5:
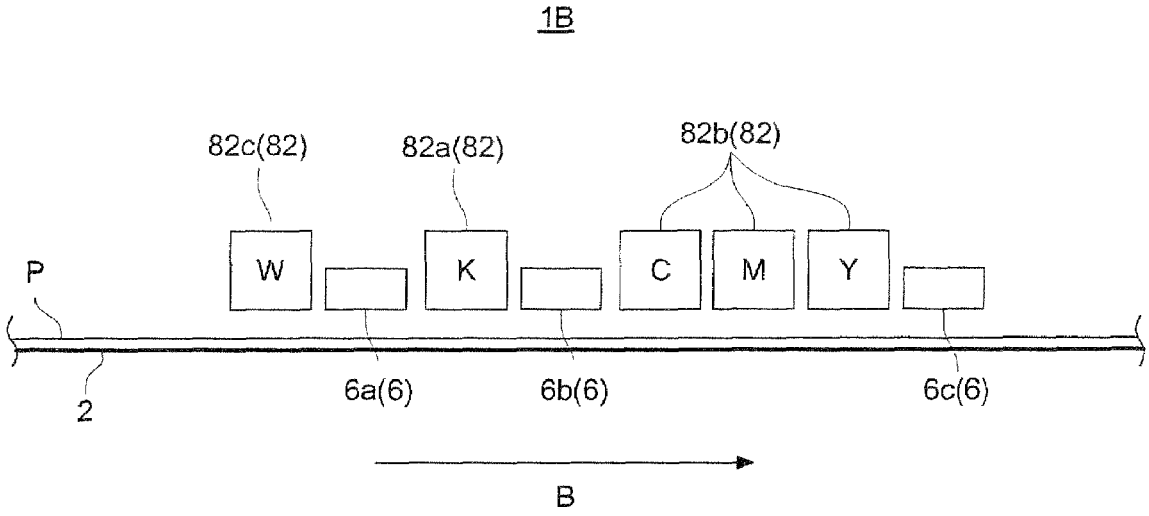
FIG. 5 is a diagram showing a modification, as an example, of a carriage provided on the ink jet recording apparatus in FIG. 4.

Further, although in the second embodiment, the line type ink jet recording apparatus 1A provided with a transparent ink recording head 81 has been described as an example, it is also possible to apply a line type ink jet recording apparatus provided with only coloring ink recording heads 82 without a transparent ink recording head 81. For example, as shown in FIG. 5, an ink jet recording apparatus 1B having a black ink recording head 82*a*, color ink recording heads 82*b*, and a white ink recording head 82*c*, as coloring ink recording heads 82, can be achieved. In the following, this ink jet recording apparatus 1B will be described referring to FIG. 5, giving the same reference symbols to elements in common with the ink jet recording apparatus 1A shown in FIG. 3 and omitting the description of them.

On the ink jet recording apparatus 1B, there are disposed a black ink recording head 82*a*, color ink recording heads 82*b*, and a white ink recoding head 82*c* along a conveyance direction B. The white ink recording head 82*c* jets a white ink (W) containing a white colorant toward a recording medium P. In recording an image with this ink jet recording apparatus 1B, when the recording medium P is conveyed in the conveyance direction B, first, the white ink recording head 82*c* jets the white ink onto the recording medium P, and the light emitting device 6*a* located just downstream side of the white ink recording head 82*c* cures the white ink on the recording medium P. Next, the black ink recording head 82*a* jets the black ink onto the recording medium P, and the light emitting device 6*b* located just downstream side of the black ink recording head 82*a* cures the black ink on the recording medium P. Finally, the respective color ink recording heads 82*b* jet the color inks onto the recording medium P, and the light emitting device 6*c* located just downstream side of the color ink recording heads 82*b* cures the color inks on the recording medium P.

As described above, the white ink, the black ink, and the group of the color inks are cured each individually. Therefore, the white ink, the black ink, and the group of the color inks are prevented from mixing with each other, which reduces ink bleeding and reduces increase in a dot diameter to improve the image quality.

What is claimed is:

1. An ink jet recording apparatus, comprising:

a black ink recording head for jetting a photocurable black ink onto a recording medium;

a basic color ink recording head for jetting a photocurable basic color ink of a color other than black onto the recording medium;

a light emitting device for emitting light to the black ink and the basic color ink on the recording medium to cure the inks; and a controlling device that controls the black ink recording head and the basic color ink recording head to conduct scanning movements in first and second directions to jet ink such that:

(i) during the scanning movement in the first direction, the black ink recording head jets the black ink onto the recording medium, the light emitting device cures the black ink on the recording medium, and then the basic color ink recording head jets the basic color ink onto the recording medium and the light emitting device cures the basic color ink on the recording medium, and (ii) during the scanning movement in the second direction, the basic color ink recording head jets the basic color ink onto the recording medium, the light emitting device cures the basic color ink on the recording medium, and then the black ink recording head jets the black ink onto the recording medium and the light emitting device cures the black ink on the recording medium.

* * * * *